US006183059B1

(12) United States Patent
Muhl et al.

(10) Patent No.: US 6,183,059 B1
(45) Date of Patent: Feb. 6, 2001

(54) DEVICE FOR CLEANING AN INK JET PRINT HEAD

(75) Inventors: Wolfgang Muhl; Michael Seikel, both of Berlin (DE)

(73) Assignee: Francotyp-Postalia AG & Co., Birkenwerder (DE)

( * ) Notice: Under 35 U.S.C. 154(b), the term of this patent shall be extended for 0 days.

(21) Appl. No.: 09/099,475

(22) Filed: Jun. 18, 1998

(30) Foreign Application Priority Data

Jun. 18, 1997 (DE) ..... 197 26 643

(51) Int. Cl.[7] ..... B41J 2/165
(52) U.S. Cl. ..... 347/33; 347/30; 347/31
(58) Field of Search ..... 347/29, 30, 31, 347/32, 33

(56) References Cited

U.S. PATENT DOCUMENTS

| | | | | |
|---|---|---|---|---|
| 5,094,554 | * | 3/1992 | Hurd et al. | 400/59 |
| 5,300,958 | * | 4/1994 | Burke et al. | 347/33 |
| 5,432,539 | * | 7/1995 | Anderson | 347/33 |
| 5,757,387 | * | 5/1998 | Manduley | 347/33 |
| 5,765,475 | * | 6/1998 | Salomon | 347/32 |
| 5,793,391 | * | 8/1998 | Kawakami et al. | 347/33 |
| 5,798,775 | * | 8/1998 | Takahashi et al. | 347/33 |
| 5,813,326 | * | 9/1998 | Salomon | 347/4 |
| 5,896,143 | * | 4/1999 | Matsui et al. | 347/24 |

FOREIGN PATENT DOCUMENTS

| | | | | |
|---|---|---|---|---|
| 0 494 693 A1 | | 7/1992 | (EP) | B41J/2/165 |
| WO 96/15908 | * | 5/1996 | (WO) | B41J/2/165 |

OTHER PUBLICATIONS

International Patent Application WO 96/15908 (Schut et al.) dated May 30, 1996.

Japanese Patent Abstract No. 08048043 A (Nakamura, B.), dated Feb. 20, 1996.

* cited by examiner

*Primary Examiner*—N. Le
*Assistant Examiner*—Shih-wen Hsieh
(74) *Attorney, Agent, or Firm*—Herbert L. Lerner; Laurence A. Greenberg; Werner H. Stemer

(57) ABSTRACT

An assembly for cleaning an ink jet print head which is stationary in a postage meter and/or addressing machine behind a guide plate for imprintable media in a print window. The ink jet print head is pivotable between a printing position and a cleaning and/or sealing position. A cleaning and sealing device is also disposed behind the guide plate and it is selectively movable towards the ink jet print head for cleaning and/or sealing. The cleaning and sealing device includes a sealing cap adapted to the front side of the ink jet print head, along with a transversely sweeping wiper lip and a vacuuming device. The sealing cap defines a suction region for the wiper lip, and the ink jet print head in its housing has a compartment with a replaceable absorbent filling. The wiper lip is not only stripped along the filling but also vacuumed via the suction region. The suction region is also used to vacuum the filling. This prevents soiling of the nozzle face from residual ink on the wiper lip.

9 Claims, 6 Drawing Sheets

DEVICE FOR CLEANING AN INK JET PRINT HEAD

BACKGROUND OF THE INVENTION

1. Field of the Invention

The invention relates to a device for cleaning an ink jet print head, particularly in a postage meter and/or addressing machine.

Prior art postage meter and/or addressing machines on the market print primarily with ink rollers or thermal print heads.

Recently effort has been directed to exploiting the advantages of ink jet printing to the field of applying postage and/or addressing mail by machine. The printing operation is thereby contact-less by means of ink jet print heads. Reference is had, in this context, to German Patent DE 44 24 771 C1 and to German Utility Model DE 94 20 734 U1.

A postage meter has been proposed in German Patent DE 196 05 014 C1 in which the letters are conveyed upright, tilting slightly backward, with the aid of a conveyor belt.

The letters there rest on a guide plate with a printing window in which the ink jet print head is fixed. The letter is moved past the printing window or ink jet print head and during this time is imprinted on the side facing away from the observer. The problem of ink jet print head cleaning and sealing, however, is not addressed there.

A device for cleaning an ink jet print head has become known from international publication WO 96/15908, wherein the ink jet print head is secured so as to be pivotable out of a printing position into a cleaning position and/or sealing position and vice versa. A cleaning and sealing device is also disposed behind the guide plate but in such a way that it is linearly adjustable toward and away from the ink jet print head.

The cleaning and sealing device includes a sealing cap, adapted to the ink jet print head, with suction slits for each row of nozzles. The device also includes a transversely adjustable wiper lip and a downstream suction pump.

In the sealing cap, on one end, a vacuuming region is also provided, with a central suction opening for the wiper lip. The wiper lip can be adjusted with a spindle drive. In that process the wiper lip slides under pressure along the nozzle face of the ink jet print head and in so doing carries away residual ink located thereon. In the associated vacuuming region, the wiper lip is stopped and vacuumed off. Via the suction opening, however, only the residual ink located in the lower middle part of the wiper lip is vacuumed off, so that the next time the nozzle face is wiped off there is a danger that it will smear. A further consideration is that when the wiper lip is separated from the nozzle face, some of the residual ink remains behind on the print head edge because of adhesion; it can collect into a droplet and then drip into the space located below the ink jet print head. There is also the danger that when the cleaning and sealing device is disconnected from the ink jet print head, the wiper lip, which is curved under pressure, will suddenly snap back and throw off some of the residual ink still present on the wiper lip by centrifugal force. Not only can it thus cause undesired contamination but it can even cause damage in the device, especially if the ink is conductive.

A further ink jet printer is known from Japanese patent disclosure JP 08 048043, in which a compartment with a replaceable, absorbent filling for cleaning the wiper lip is provided in the housing of an ink jet print head.

It is a desirable goal to improve cleaning the ink jet print head and maintaining the ink jet print head clean.

SUMMARY OF THE INVENTION

It is accordingly an object of the invention to provide a device for cleaning an ink jet print head, which overcomes the above-mentioned disadvantages of the prior art devices and methods of this general type and wherein an ink jet print head disposed stationary behind a guide plate can be adjusted out of the printing position into a cleaning position and/or into a sealing position and back again, and wherein a cleaning and sealing device adapted to the ink jet print head and provided with a wiper lip can be coupled for proper function with the ink jet print head. In particular, the function of the wiper lip is to be improved.

With the foregoing and other objects in view there is provided, in accordance with the invention, an ink jet print head assembly in a postage meter and/or addressing machine, comprising:

an ink jet print head disposed in a postage meter and/or addressing machine behind a guide plate for imprintable media, the ink jet print head having a housing and a front face, and being pivotally mounted between a printing position and a cleaning position;

a cleaning and sealing device disposed behind the guide plate and mounted to be linearly adjustable toward and away from the ink jet print head;

the cleaning and sealing device including a sealing cap adapted to a front face of the ink jet print head, a transversely adjustable wiper lip, and a vacuuming device;

the sealing cap having a suction region defined on one end thereof for cleaning the wiper lip; and the housing of the ink jet print head having a compartment formed therein and a replaceable absorbent filling disposed in the compartment, the compartment and the filling being operatively associated with the suction region for the wiper lip and being adapted to a contour thereof.

In accordance with an added feature of the invention, the absorbent filling terminates even with a nozzle plane toward the front side of the ink jet print head, and the compartment is adapted to the dimensions of the wiper lip.

Because the ink jet print head and the cleaning and sealing device are disposed on the same side of the guide plate for the imprintable media, a closed, compact structure of the postage meter and a simple design of the imprintable media transport system are made possible.

Due to the fact that the ink jet print head is merely pivoted, a fast and precise return from the cleaning position to the printing position is assured. The adjusting mechanisms for the ink jet print head and for the cleaning and sealing device can be connected to one another and designed in such a way that coupling with accurate positions and reliable function is made possible.

Because the nozzle face to be cleaned and the absorbent filling are disposed in alignment with one another, both the article to be cleaned (i.e., the nozzle face) and the cleaning means (i.e., the wiper lip) can be cleaned in a single course of motion.

In accordance with an additional feature of the invention, the absorbent filling is secured in the compartment by a force-lock and/or by a form-lock. The absorbent filling is thus easily replaced. Constant cleaning quality can be achieved without problems. The absorbent filling absorbs not only ink residue but also dust particles. This is important, since as a consequence of the imprintable media being moved past the nozzle face, paper dust is created and deposited on the assembly to an increased extent.

Because of the improved cleaning of the wiper lip, in turn, better cleaning of the nozzle face of the ink jet print head is achieved and smearing of the nozzles is avoided.

In accordance with another feature of the invention, rubber-elastic flanges are inserted in the sealing cap associated with rows of nozzles on a nozzle face of print head and with the wiper lip, respectively, and a suction pump communicates with the rubber-elastic flanges through a hose connection, and wherein, when the sealing cap is docked with the ink jet print head, the flanges are force-locked on the nozzle face and the filling, respectively.

In accordance with again another feature of the invention, the ink jet print head is rigidly mounted on a rotatable shaft.

In accordance with yet another feature of the invention, the wiper lip comprises a wiper lip housing with a rubber-elastic, T-shaped doctor blade insert and a holding plate retaining the doctor blade insert in the wiper lip housing, and including guide shafts secured outside of and parallel to the sealing cap along which the wiper lip is linearly movable.

In accordance with a concomitant feature of the invention, the suction openings are formed centrally in the doctor blade insert and the housing.

Other features which are considered as characteristic for the invention are set forth in the appended claims.

Although the invention is illustrated and described herein as embodied in a device for cleaning an ink jet print head, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
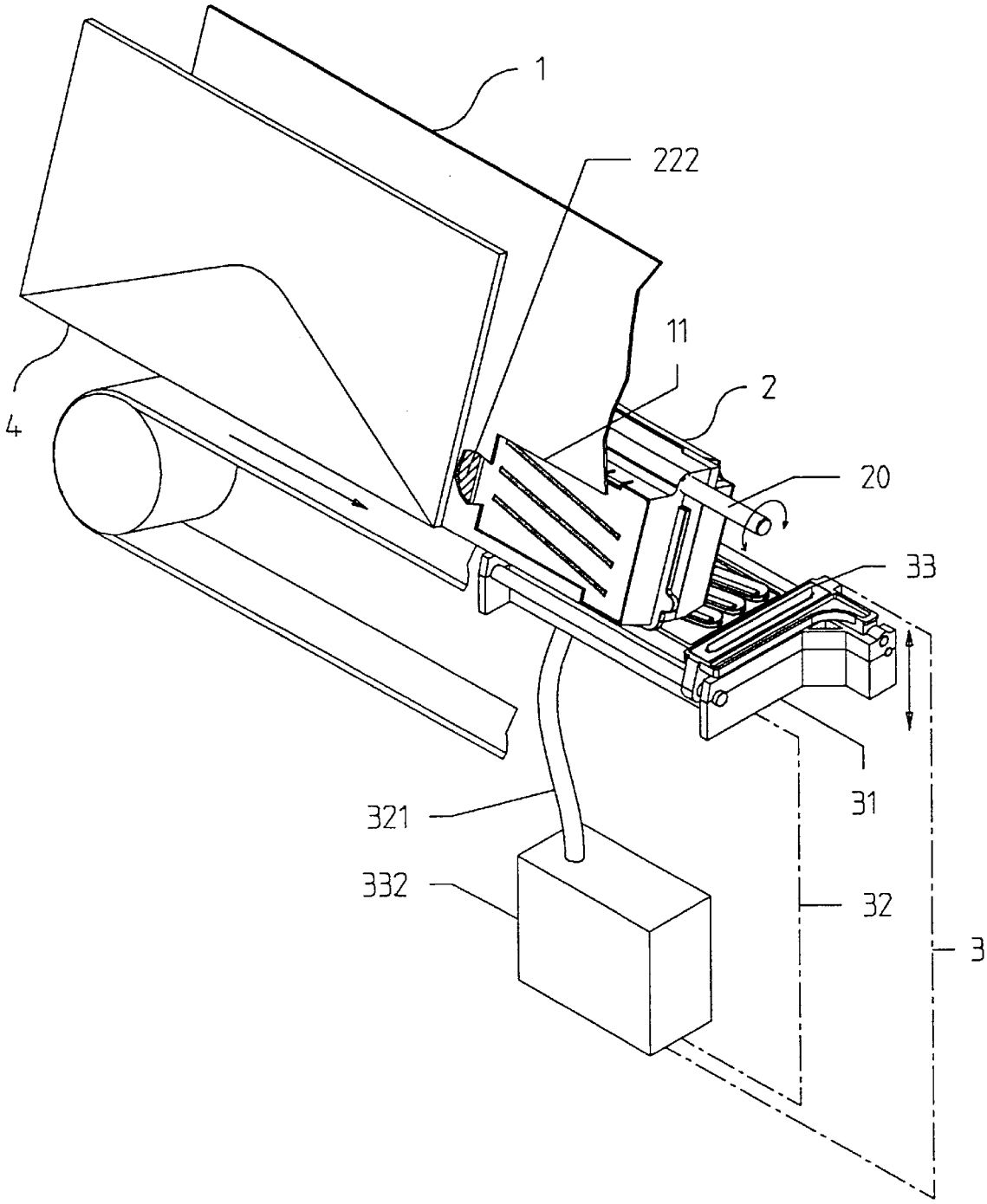
FIG. 1 partial, partly sectional, perspective view of a postage meter with the configuration according to the invention.

Referring now to the figures of the drawing in detail and first, particularly, to FIG. 1 thereof, there is seen a postage meter guide plate 1 for imprintable media 4, such as letters or printed postage labels. The guide plate 1 is formed with a printing window 11, in which an ink jet print head 2 is disposed in stationary fashion. The imprintable media 4 slide continuously past the printing window 11, contacting the front side of the guide plate 1, and they are thereby imprinted by the ink jet print head 2. The ink jet print head 2 is secured to the back side of the guide plate 1 on a shaft 20 and protrudes slightly into the printing window 11. Upon the rotation of the shaft 20, the ink jet print head 2 is pivoted between two terminal positions. The one terminal position—visible in FIG. 1—is equivalent to the "printing position," in which a nozzle plane 210 is parallel to the guide plate 1. The other terminal position—see FIGS. 3–5—corresponds to the "cleaning position", in which the nozzle plane 210 is parallel to the front side of a sealing cap 31.

Figure 2:
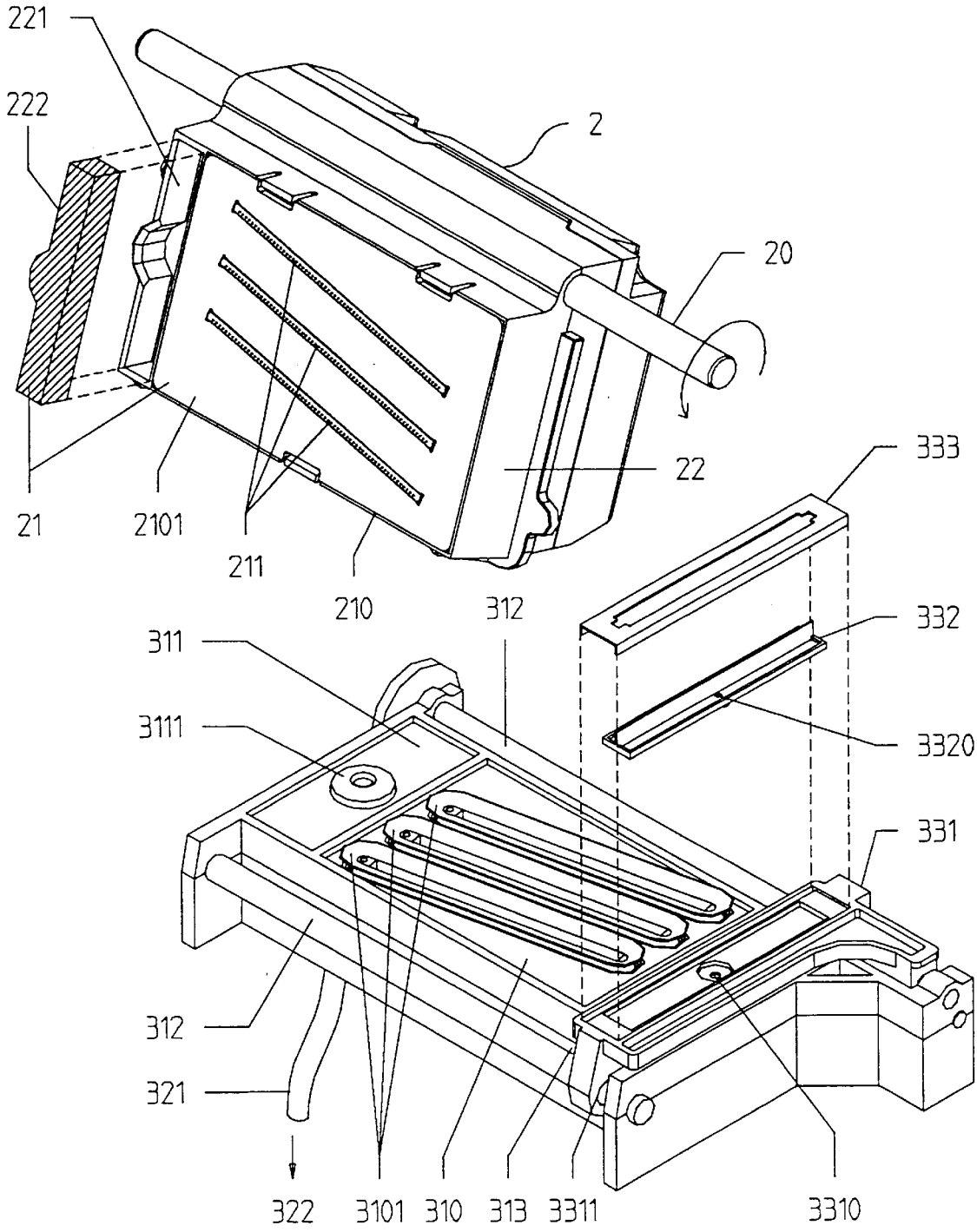
FIG. 2 is a partly exploded perspective view of an ink jet print head and a sealing cap with a wiper lip in the printing position of FIG. 1.

The ink jet print head 2 in this case is composed of three ink jet printing modules that operate on the "non-interlaced" principle, and thus three rows of nozzles 211 can be seen one above the other on the front; see also FIG. 2.

The ink jet printing modules protrude with their end face into suitably adapted and associated slots in a front panel 210, whose outside face corresponds to the nozzle plane or nozzle face 2101.

A cleaning and sealing device 3, which comprises an adjustable-height sealing cap 31, a wiper lip 33, and a vacuuming device 32 is disposed below the ink jet print head 2. The vacuuming device 32 has hose connection 321 to the sealing cap 31 and a stationary suction pump 322.

In FIG. 2, the ink jet print head 2 assumes the printing position, and the sealing cap 31 assumes the position farthest away from the ink jet print head 2.

The housing 22 of the ink jet print head 2 includes not only the ink jet printing modules but also a compartment 221 with an absorbent filling 222. The absorbent filling 222 may be a sponge or a nonwoven fabric.

The filling 222 is inserted into the compartment 221 and dimensioned in such a way that it is flush with the outer face 2101 of the front panel 210, or with the nozzle plane 2101. It is assured in this way that the wiper lip 33, after sweeping over the nozzle face 2101, is wiped off at the absorbent filling 222 in such a way that ink residues are neither thrown off centrifugally into the surroundings nor transferred back onto the nozzle face. The effect can be still further reinforced by a suitable control of the sealing cap decoupling.

The filling 222 is secured selectively in force-locking, form-locking, or both force- and form-locking fashion in the compartment 221. For the force-locking fastening—also referred to as a friction-lock—it is sufficient to render the filling 222 slightly oversize as compared with the compartment 221. For the form-locking fastening, the two elements are provided with profiles that mesh with one another.

Two guide shafts 312 are secured on both sides on the outside of and parallel to the long sides of the sealing cap 31. The wiper lip 33 with its housing 331 is secured linearly adjustably on the guide shafts 312. To that end, the housing 331 is provided with bushes 3311, which are adapted to the guide shafts 312. A rubber-elastic, T-shaped doctor blade insert 332 is disposed in the housing 331 of the wiper lip 33; with its long leg, it protrudes through a slot in a holding plate 333 that is locked in detent fashion to the housing 331. In the doctor blade insert 332, at least one opening 3320 is provided centrally in each of the short legs. At least one suction opening 3320 is likewise formed centrally in the housing 331. Through these openings 3320 and 3310, residual ink can flow out or be removed by vacuuming. The doctor blade insert 332, in functional terms, forms the actual wiper lip.

The sealing cap 31 is divided into three functional regions:

- a suction region 310 for the nozzle rows 211;
- a suction region 311 for the wiper lip 33 and the filling 222; and
- a maintenance region 313 for the wiper lip 33.

Correspondingly, three rubber-elastic trough-like flanges 3101 are inserted into the suction region 310 for the three nozzle rows 211. The flanges 3101 are adapted to the geometry of the nozzle rows 211 and are connected via the sealing cap housing to the hose connection 321 to the suction pump 322.

In the suction region 311 for the wiper lip 33, a rubber-elastic, round flange 3111 is inserted centrally. The round flange 3111 likewise communicates through the hose connection 321 with the suction pump 322, via the sealing cap housing. When the wiper lip 33 is positioned in the suction region 311, the suction openings 3310 and 3320 are docked with the flange, and the residual ink can be vacuumed from the wiper lip 33; see also FIGS. 5 and 6.

Figure 3:
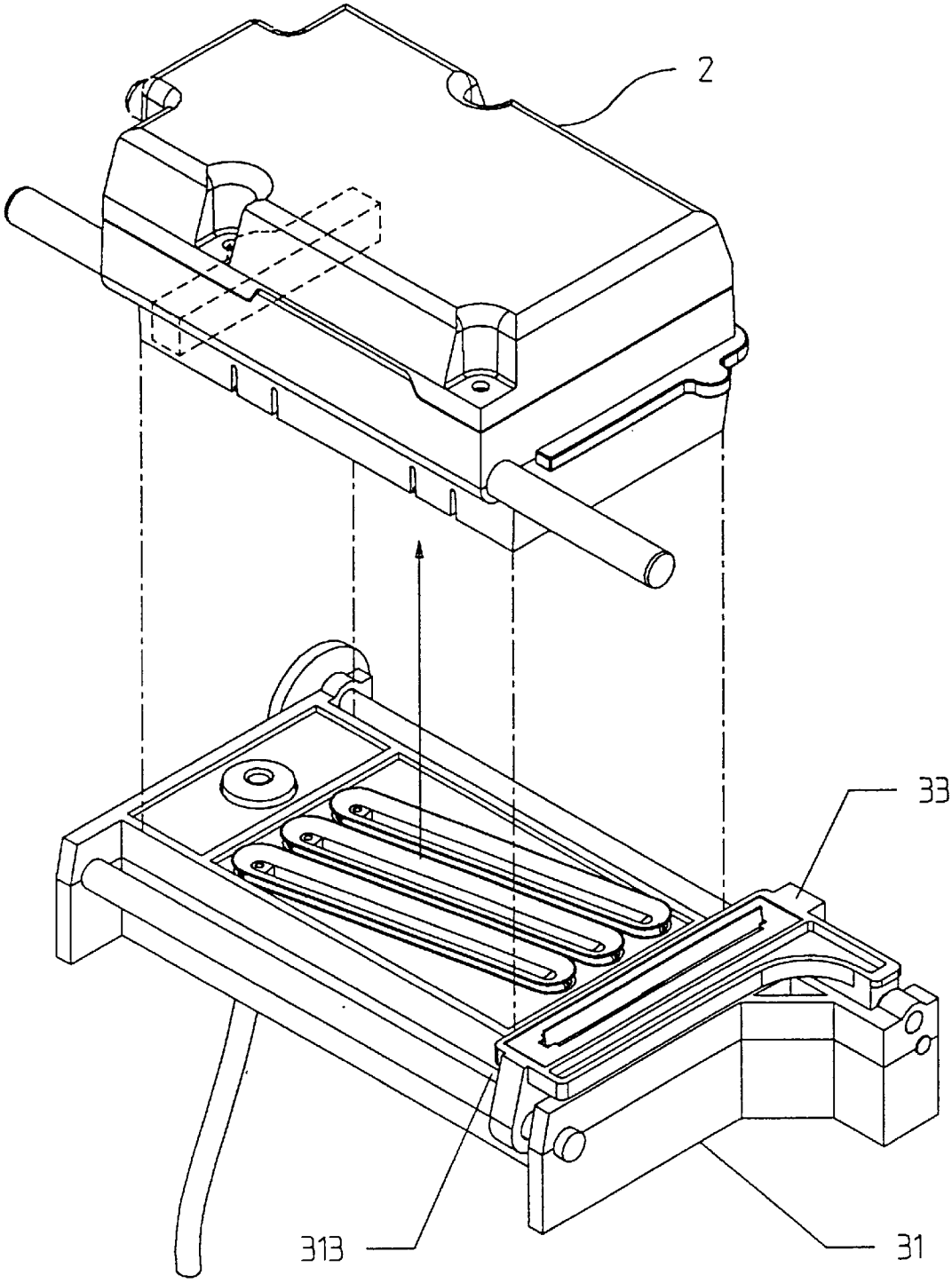
FIG. 3 is perspective view of an ink jet print head and a sealing cap with the wiper lip, in an approach position.

With reference to FIG. 3, the ink jet print head 2 is pivoted so far to the rear that its front side 21 is disposed parallel to the top side of the sealing cap 31. The wiper lip 33 remains in the maintenance region 313. The sealing cap 31 can now be driven upward toward the ink jet print head 2.

Figure 4:
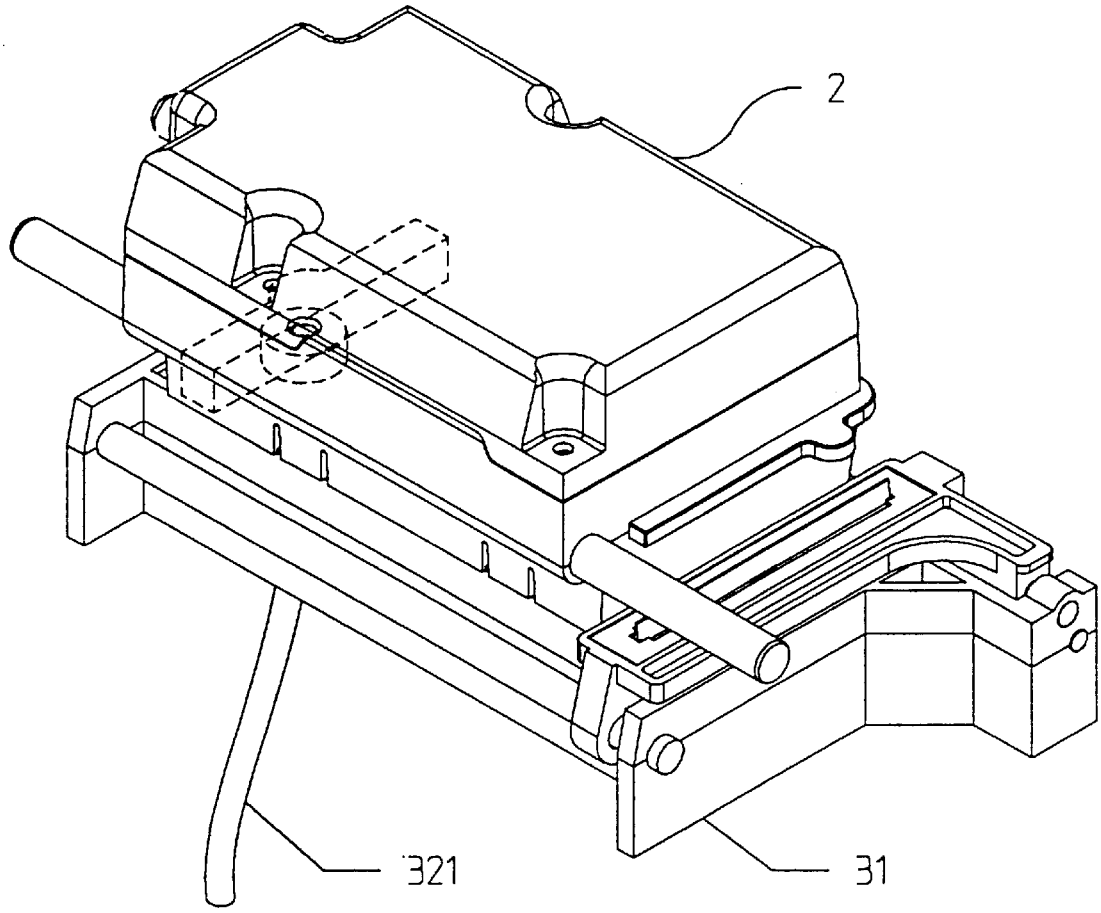
FIG. 4 is a perspective view of the ink jet print head with the sealing cap docked.

With reference to FIG. 4, by its part that covers the front side 21 of the ink jet print head 2, the sealing cap 31 is docked with the ink jet print head 2. The rubber-elastic flanges 3101 are friction-locked on the nozzle face 2101. The ink jet print head 2 can now be primed and vacuumed, or if there is a relatively long interval when no printing is done, it is merely sealed off. Analogously, the rubber-elastic flange 3111 rests on the absorbent filling 222 and can also be vacuumed off. The wiper lip 33 is then located outside the ink jet print head 2, in the associated maintenance region 313 of the sealing cap 31.

Figure 5:
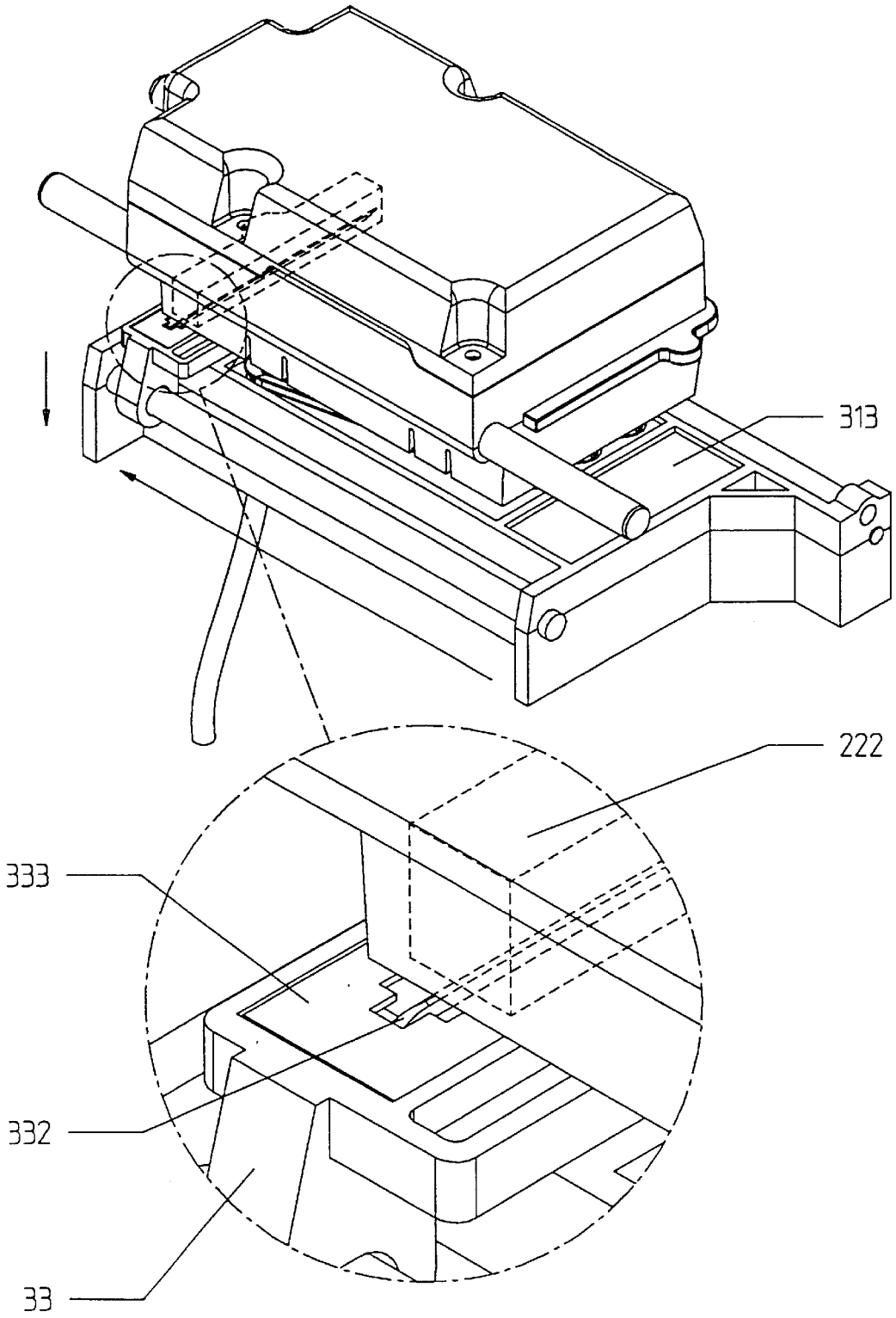
FIG. 5 is a perspective view of the ink jet print head and the sealing cap in the wiping position, and an enlarged detail.

In FIG. 5, the sealing cap 31 has just now moved far enough away from the ink jet print head 2 that the wiper lip 33, with the rubber-elastic doctor blade insert 332, can sweep along the nozzle face 2101 and then along the absorbent filling 222. In the terminal position, the wiper lip 33 rests on one side on the filling 222 while on the other it is disposed above the associated suction region 311.

Figure 6:
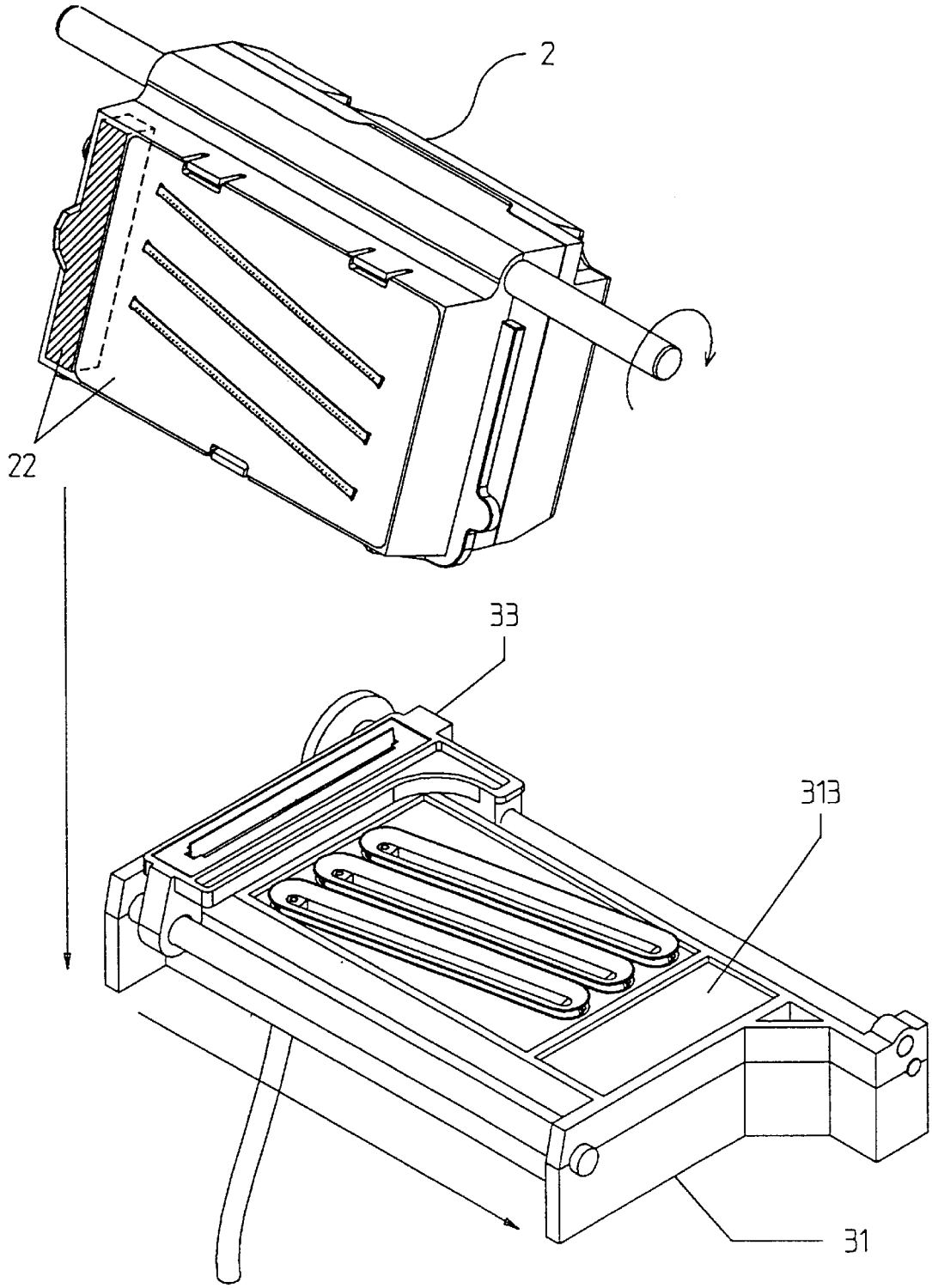
FIG. 6 is a perspective view of the ink jet print head in the printing position and of the sealing cap with the wiper lip in the vacuuming position.

In FIG. 6, the ink jet print head 2 has rotated back into the printing position, and the sealing cap 31 has moved downward to the most distant position. After vacuuming in the suction region 311 for a sufficiently long time, the wiper lip 33 is displaced into the maintenance region 313 on the right. If needed, the used absorbent filling 222 is replaced with a fresh filling.

We claim:

1. An ink jet print head assembly in a postage meter and/or addressing machine, comprising:

an ink jet print head disposed in a postage meter and/or addressing machine behind a guide plate for imprintable media, said ink jet print head having a housing and a front face, and being pivotally mounted between a printing position and a cleaning position;

a cleaning and sealing device disposed behind the guide plate and mounted to be linearly adjustable toward and away from said ink jet print head;

said cleaning and sealing device including a sealing cap adapted to a front face of said ink jet print head, a transversely adjustable wiper lip, and a vacuuming device;

said sealing cap having a suction region defined on one end thereof for cleaning said wiper lip; and said housing of said ink jet print head having a compartment formed therein and a replaceable ink absorbent filling disposed in said compartment, said compartment and said filling being operatively associated with said suction region for said wiper lip.

2. The device according to claim 1, wherein said absorbent filling terminates even with a nozzle plane toward said front face of said ink jet print head, and wherein said compartment is sized to dimensions of said wiper lip.

3. The device according to claim 2, wherein said absorbent filling is secured in said compartment by at least one of a force-lock and a form-lock.

4. The device according to claim 1, including rubber-elastic flanges inserted in said sealing cap associated with rows of nozzles on a nozzle face of print head, wherein said vacuuming device includes a hose connection and a suction pump communicating with said rubber-elastic flanges through said hose connection, and when said sealing cap is docked with said ink jet print head, said flanges are force-locked on said nozzle face and said filling, respectively.

5. The device according to claim 4, wherein said wiper lip comprises a wiper lip housing with a rubber-elastic, T-shaped doctor blade insert disposed in said wiper lip housing, and wherein said doctor blade insert is formed with a suction opening disposed centrally therein and said wiper lip housing is formed with a suction opening disposed centrally therein.

6. The device according to claim 1, which further comprises a shaft supporting said ink jet print head.

7. The device according to claim 6, wherein said shaft is rotatably mounted and said print head is rigidly secured to said shaft.

8. The device according to claim 1, wherein said wiper lip comprises a wiper lip housing with a rubber-elastic, T-shaped doctor blade insert and a holding plate retaining said doctor blade insert in said wiper lip housing, and including guide shafts secured outside of and parallel to said sealing cap along which said wiper lip is linearly movable.

9. An ink jet print head assembly in a postage meter and/or addressing machine, comprising:

a guide plate formed with an opening;

an ink jet print head disposed in a postage meter and/or addressing machine behind said guide plate, said ink jet print head having a housing and a front face, and being pivotally mounted between a printing position and a cleaning position, said ink jet print head protruding into said opening when pivoted to said printing position;

a cleaning and sealing device disposed behind the guide plate and mounted to be linearly adjustable toward and away from said ink jet print head;

said cleaning and sealing device including a sealing cap adapted to a front face of said ink jet print head, a transversely adjustable wiper lip, and a vacuuming device;

said sealing cap having a suction region defined on one end thereof for cleaning said wiper lip, said suction region communicating with said vacuuming device; and said housing of said ink jet print head having a compartment formed therein and a replaceable ink absorbent filling disposed in said compartment, said compartment communicating with said suction region for said wiper lip when said ink jet print head is in said cleaning position.

* * * * *